US006896972B2

(12) United States Patent
Hollmann

(10) Patent No.: US 6,896,972 B2
(45) Date of Patent: May 24, 2005

(54) ROUND FORMWORK MODULE

(75) Inventor: Niels Hollmann, Olang (IT)

(73) Assignee: Alpi AG, Welsberg (IT)

( * ) Notice: Subject to any disclaimer, the term of this patent is extended or adjusted under 35 U.S.C. 154(b) by 104 days.

(21) Appl. No.: 10/257,686

(22) PCT Filed: Mar. 30, 2001

(86) PCT No.: PCT/EP01/03662

§ 371 (c)(1),
(2), (4) Date: Jan. 30, 2003

(87) PCT Pub. No.: WO01/79625

PCT Pub. Date: Oct. 25, 2001

(65) Prior Publication Data

US 2003/0148137 A1 Aug. 7, 2003

(51) Int. Cl.[7] ..... E04G 11/06
(52) U.S. Cl. ..... 428/615; 249/13; 249/18; 249/48; 425/470
(58) Field of Search ..... 428/615; 249/13, 249/18, 48; 425/470

(56) References Cited

U.S. PATENT DOCUMENTS 6,530,552 B2 * 3/2003 Bergaretxe ..... 249/18

FOREIGN PATENT DOCUMENTS

| | | |
|---|---|---|
| DE | 21 40 638 | 3/1973 |
| DE | 89 08 345.8 | 11/1989 |
| DE | 38 41 579 | 6/1990 |
| DE | 39 41 937 | 6/1991 |
| DE | 41 16 439 | 8/1992 |
| DE | 94 10 525.1 | 9/1994 |

* cited by examiner

*Primary Examiner*—Robert R. Koehler
(74) *Attorney, Agent, or Firm*—Bachman & LaPointe, P.C.

(57) ABSTRACT

A round formwork module comprising a flexible skin having a front side which, when used, constitutes the forming surface for a concrete structure which is to be cast, and also provided with a rear side and a supporting structure which is arranged on the rear side of the skin and which can be displaced in order to enable the skin to be bent along a direction in which it extends. The invention is characterized in that the supporting structure has a base structure and two side elements which are arranged laterally, close to the base structure. The side elements are respectively secured to a lateral edge area of the skin and protrude therefrom close to the base structure. An adjustment device for adjusting the curvature is provided in between the base structure and the side elements.

13 Claims, 5 Drawing Sheets

ROUND FORMWORK MODULE

The present invention relates to a round formwork module having a flexible skin with a front forming in use the shaping surface for the concrete structure to be cast, and a back, and a support structure that is disposed on the back of the skin and adjustable to permit curvature of the skin along a direction of extension of the skin.

Such round formworks are known from various formwork suppliers and described for example in DE 89 08 345 U1 and DE 41 16 439 C1. They can be used to cast for example circular or other curved structures of concrete. Typical examples are round walls around spiral staircases or circular clarification basins. A round formwork for such walls typically has an inner formwork and an outer formwork. Both are constructed of a plurality of individual round formwork modules. Known round formwork systems have the disadvantage of being formed of very many different components that must be put together in a complicated way at the building site. This requires extensive stockkeeping and leads to elaborate assembly at the building site. A further disadvantage is that the curvature of individual round formwork modules is sometimes hard to adjust before assembly. In particular, the two lateral edge areas of a round formwork module in the direction of curvature with which one round formwork module to the next are frequently [part of sentence missing—The Translator] additionally impedes assembly on the building site. The reason for this is the static indeterminacy of all these constructions. Thus, the displacement limits for the lateral edge areas are connected flexibly at both end areas to the support structure and the skin, which impedes defined positioning of said edge areas solely through said displacement limits. Simply clamping together two adjacent round formwork modules does not remedy this problem. To solve this problem, a further displacement screw is provided between two connected round formwork modules for effecting the fine positioning. In some systems it is accordingly only possible to adjust the curvature of the lateral edge areas correctly when the round formwork module is connected with the circumferentially next round formwork module. In this case the meeting edge areas of two round formwork modules must be adjusted correctly in their curvature, and it is obvious that this particularly impedes assembly. Moreover, said edge area is statically indeterminate according to the known criteria for timbering at least in some of these systems, so that the curvature cannot be adjusted correctly in said area at least before the assembly of a plurality of round formwork modules. However, particularly the abutment between two round formwork modules, i.e. the area where two round formwork modules abut, is of especially high importance for good quality of the formwork and accordingly of the wall cast with said formwork. Optimally, the abutting surfaces extend exactly radially, i.e. perpendicular to the tangent to the concrete wall to be cast in the area of the abutment. Only this allows correct joining of two round formwork modules. If this stipulation is not met, either a gap arises between the two round formwork modules, which concrete can flow into during casting, or the skins of the two round formwork modules are not smoothly joined, i.e. a crack develops at this place in the finished concrete structure.

The problem of the present invention is to provide a round formwork module and round formwork wherein the abutting surfaces in the curved state are always directed correctly radially to the center of the circle whose radius is adjusted in the round formwork module, which can be assembled into a round formwork from a plurality of round formwork modules with little labor on the building site, and is readily stackable.

This problem is solved according to the invention by an above-described round formwork module characterized in that the support structure has a base structure and two side elements disposed laterally beside the base structure in the direction of curvature, the side elements each being fastened to a lateral edge area of the skin and protruding from there into the proximity of the base structure, and a lockable adjusting apparatus being provided between the base structure and each of the side elements for adjusting the curvature.

The invention thus differs from DE 8908345 U1 and DE 4116439 C1 firstly in that a stable base structure is present. In contrast, DE 4116439 C1 shows a support structure with a plurality of joints and a plurality of displacement screws. DE 890834 U1 shows a similar structure. Further, according to the invention there are side elements each fastened to the lateral edge area of the skin and protruding from there into the proximity of the base structure. This "console" displaces the pivot of the displacement segment away from the lateral edge area to the base structure. It further makes it possible to provide near the base structure on the displacement element only one pivot about which the side elements are displaced with the skin in defined fashion.

According to this inventive solution, the flexible skin is fastened to the two lateral edge areas on the support structure and can move substantially freely therebetween, The two side elements can be moved like wings relative to the base structure. The skin assumes therebetween a state in which the tensions therein are distributed preferably evenly, which corresponds to the circular form with rather good approximation. A corresponding choice of geometries ensures that the lateral abutting surfaces of the round formwork module, i.e. the surfaces where one round formwork module abuts the circumferentially adjacent round formwork module, always extend radially to the corresponding center of the circle in this construction. This permits simple assembly of a corresponding round formwork. The round formwork modules are adjusted to the correct radius before assembly, whereby the correct course of the abutting surface radially to the center of the circle necessarily results. The preadjusted round formwork modules are then interconnected at their abutting surfaces without any further correction of the radius of curvature being required.

As also in the round formwork systems from the prior art, there are different round formwork modules for the inside of a curvature and the outside of a curvature. The outer round formwork modules are generally only curved concavely, while the inner round formwork modules are generally only curved convexly. To keep the distance constant between the round formwork modules of the inside and outside, conventional clamping elements are provided for interconnecting the inner formwork and outer formwork round formwork modules. Said clamping elements favorably act on the base structure of the support structure.

The direction of curvature, i.e. of extension of the skin along which the skin curves, corresponds to the circumferential direction of the circle in the case of a plurality of round formwork modules assembled in a circle. The skin is favorably fastened to the base structure to ensure for example that the skin always curves concavely in outer formwork round formwork modules. Fastening of the skin is favorably effected substantially on a line extending at right angles to the direction of curvature. It is especially favorable to effect fastening of the skin to the base structure so that there is a certain slidability of the skin relative to the base structure in the direction of curvature. This is favorable in particular when fastening of the skin to the base structure is provided along more than one line provided at right angles to the direction of curvature.

The design of the round formwork module with the special support structure firmly connected with the skin makes it possible to realize a relatively flat structure of the round formwork module, so that a round formwork module has a thickness of about 12 centimeters in the radial direction as compared with about 40 centimeters in the prior art. This flat construction obviously has a favorable effect on the stackability (low space requirement) of the round formwork modules. A further advantage is that the support structure can be designed relatively simply so that its back, i.e. the side of the round formwork module opposite the shaping surface of the skin, extends substantially in a plane, which further improves the stackability.

The support structure can in addition be of very stable construction. This makes it possible to dispense with additional reinforcement clamps, which are applied additionally from outside as a further support layer in the prior art. The resulting lower number of required components has a positive effect on the total cost of the system.

The adjusting apparatus is preferably an adjusting screw connected flexibly at least on one side to the base structure and/or the side element. Such adjusting screws can be adjusted relatively simply with a simple tool on the building site, they are easy to handle and reliably prevent an inadvertent shift.

The adjusting screw is preferably connected rigidly to the base element and connected flexibly to the side element, or vice versa. Rigid fastening on one side has the advantage of simple and cost-effective production. Furthermore, this statically determinate structure reliably prevents lateral buckling of the side element otherwise fastened "softly" with the skin to the base structure.

The base structure preferably has at least two beams extending at right angles to the direction of curvature and to which the skin is fastened. As described above, a fastening is provided, for example with screws that are slidable in long holes extending in the direction of curvature. This permits reliable tension regulation over the skin of a round formwork module upon curvature. It is equally possible to provide only one central beam. More than two beams can also be provided. It is then favorable if at least some of said beams are movable relative to some other beams.

The base structure preferably has two beams at right angles to the direction of curvature that are connected with at least two secondary beams to form a frame scaffold. This construction is very stable, which permits a flat construction of the round formwork modules. Additionally, said frame scaffold can be stiffened by a diagonal strut.

The base structure preferably has a plurality of frame scaffolds with two interconnected beams interconnected by an intermediate element. This makes it possible to realize much longer frame formwork modules in the direction of curvature, which is favorable in particular for large round formworks.

The intermediate element preferably has an elongate central beam fastened to the skin in the middle between the frame scaffolds and at right angles to the direction of curvature and from which lateral arms protrude into the proximity of the frame scaffolds, with adjusting apparatuses being provided between the arms of the intermediate element and the frame scaffold for adjusting the curvature. This construction permits the two frame scaffolds to be swiveled relative to each other to realize uniform curvature of the flexible skin over this whole long round formwork module. The skin is again preferably fastened to the elongate central beam. With the laterally protruding arms away from the central beam, said intermediate element is constructed substantially as if two side elements of a round formwork module were interconnected along the abutting surface.

The round formwork module is preferably designed in the manner of a frame formwork. Frame formworks are frequently used in customary flat formworks for lining flat concrete surfaces. Such frame formworks have a frame as a supporting structure. The skin is fastened to said frame. Two adjacent frame formwork elements are usually connected with clamps, called frame couplers. Said frame couplers clamp together the two frames contiguous at their abutting surface, aligning them with each other so that the two skins lie substantially in the same plane on the shaping side of the formwork, and clamping together the formwork modules. As an alternative to frame formworks there are so-called beam formworks in which the skin is fastened to the secondary beams. The secondary beams are connected with main beams and supported thereby. For round formworks, solely beam formworks were hitherto used. The expert world assumed that the principle of the frame formwork was not applicable to round formworks. Therefore, the feature that the round formwork module is a formwork module according to the principle of the frame formwork is regarded as independently inventive, i.e. independently of whether it is provided in connection with one or more other features of the round formwork modules described here; in particular, it is unnecessary for the features of claim 1 to be realized simultaneously.

The round formwork module is preferably designed with an interrupted frame, the side elements forming first frame parts for connection with round formwork modules laterally adjacent in use, and second frame parts being provided for connection with round formwork modules vertically adjacent in use. Laterally and vertically adjacent round formwork modules can then be connected in accordance with frame formworks for flat concrete surfaces.

The frame parts are preferably folded sheet-metal shaped parts. These are especially simple to produce, advantageous in price, stable and light.

The frame parts preferably have in cross section a depression open toward the inside of the frame and extending in the longitudinal direction for the frame couplers to engage in use for interconnecting two round formwork modules.

The skin is preferably reinforced between the base structure and the side elements.

Said reinforcement is preferably executed with a steel band. The steel band is fastened substantially to the main beam and the side element of the support structure. It is also possible to fasten the steel band directly to the skin. It is then favorable to provide the steel band throughout the total length of the round formwork module in the direction of curvature.

The invention further relates to a frame formwork having at least one frame formwork module according to any of claims 1 to 12.

The invention will be explained in more detail in the following with reference to an example shown in the drawing, in which.

Figure 1:
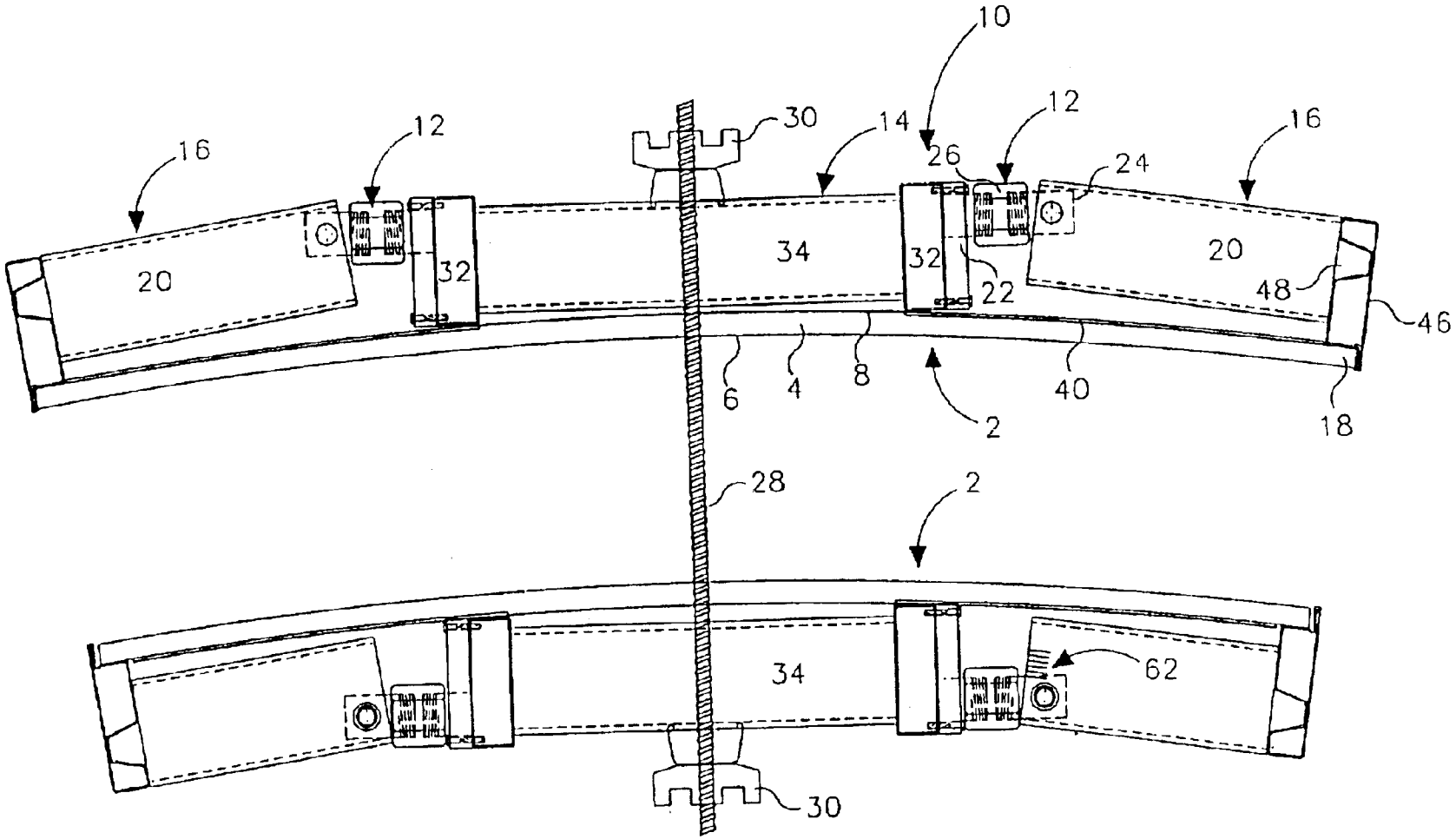
FIG. 1 shows an inner and outer round formwork module in the curved state.

FIG. 1 shows inner formwork and outer formwork round formwork module 2 both having substantially the same structure. The following description will relate substantially to outer formwork round formwork module 2. There one can see flexible skin 4 having front 6 forming the shaping surface for the concrete structure to be cast. One can further see back 8 of skin 4 that is opposite front 6. Round formwork module 2 further has support structure 10 disposed on back 8 of skin 4. Support structure 10 is designed to be adjustable by means of two adjusting apparatuses 12 in order to permit the curvature of skin 4 along a direction of extension of skin 4.

One can see that support structure 10 has base structure 14 and two side elements 16 disposed laterally beside base structure 14 in the direction of curvature. Side elements 16 are each fastened to lateral edge area 18 of skin 4 and have arms 20 protruding into the proximity of base structure 14. Between base structure 14 and each of arms 20 of side elements 16, adjusting apparatus 12 is provided for adjusting the curvature.

One can see that adjusting apparatus 12 is constructed substantially of three parts: thread lug 22 fastened firmly, i.e. without a joint, to base structure 14, thread lug 24 connected flexibly to arm 20 of side element 16, and nut 26 cooperating with the two threaded ends of thread lugs 22 and 24. The threads of thread lugs 22 and 24 are opposite, i.e. left- and right-handed threads, so that rotation of nut 26 in one direction urges arm 20 of side element 16 away from base structure 14, and rotation in the other direction draws arm 20 of side element 16 toward base structure 14. One can further see that the two round formwork modules are clamped together with turnbuckle 28 and corresponding anchor plates 30. Turnbuckle 28 and anchor plates 30 preferably each have screw threads with which they cooperate. This ensures the distance between the two round formwork modules.

One can further see that base structure 14 has two beams 32 at right angles to the direction of curvature to which skin 4 is fastened. Base structure 14 additionally has two secondary beams 34 that interconnect beams 32 and support them against each other. Beams 32 form with secondary beams 34 frame scaffold 38. In FIG. 1 one can also see steel band 40 connecting side element 16 to base structure 14.

Skin 4 consists for example of multiply wooden boards that are glued together. Such material provides sufficient strength, which is required for the intended application. Furthermore, it has sufficient flexibility to permit curvature of the boards to the desired radius, for example to a radius of 8 meters, 4 meters or even less. Other materials such as plastic materials are also conceivable.

Figure 2:
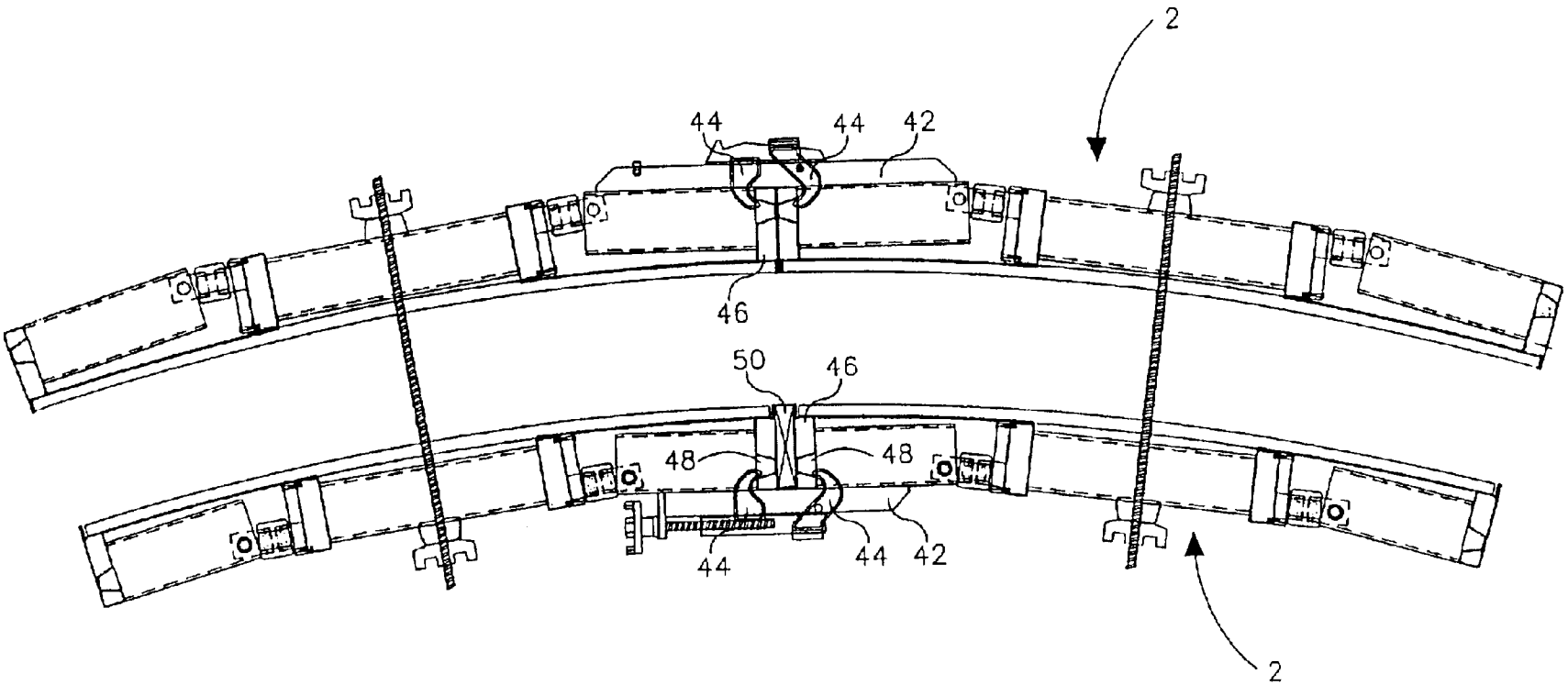
FIG. 2 shows a portion of a round formwork with inventive round formwork modules.

FIG. 2 shows a part of a round formwork consisting of two outer formwork round formwork modules 2 and two inner formwork round formwork modules 2 interconnected with different frame couplers 42 at the connecting area. One can see that the round formwork modules are constructed according to the principle of the frame formwork with a plurality of frame formwork elements being interconnected with frame couplers 42 at the corresponding adjacent frame parts. One can see in the Figure how gripping elements 44 of the frame couplers engage depressions 48 open toward the inside of the frame in the frame parts, and thus firmly clamp together circumferentially adjacent round formwork modules 2. Suitable choice of the form of gripping elements 44 and depression 48 permits round formwork modules 2 to be correctly aligned with each other in this way. The interconnection of vertically adjacent round formwork modules 2 works in similar fashion. At the place where the two inner formwork round formwork modules 2 are interconnected, one can see distance piece 50 that is set with surfaces extending substantially parallel to each other between the abutting surfaces of the two round formwork modules. Since the round formwork modules have a predetermined length in the direction of curvature, distance elements 50 are required for constructing round formworks with radii leading to circumferential lengths that are not integral multiples of a length of one round formwork module 2. Distance pieces 50 can be used both for inner formwork round formworks and for outer formwork round formworks. Distance pieces of equal thickness are generally used at each connecting point between round formwork modules 2 of a round formwork.

Figure 3:
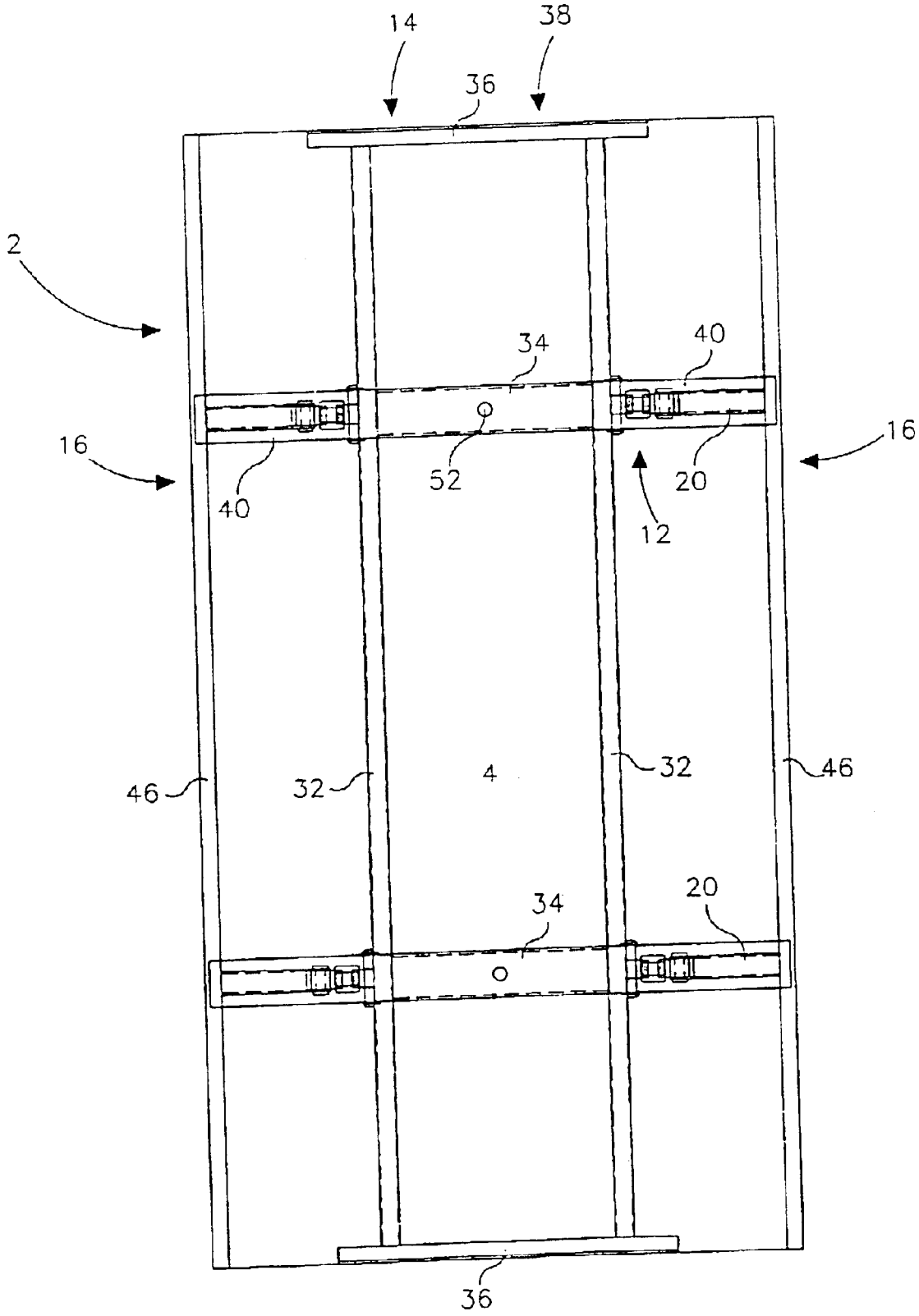
FIG. 3 shows a back view of an inventive round formwork module.

FIG. 3 shows a back view of round formwork module 2 showing especially well the structure of support structure 10. One can again see base structure 14 and the two side elements 16 disposed laterally beside base structure 14 in the direction of curvature. One can see two beams 32 of base structure 14 that extend at right angles to the direction of curvature, and two secondary beams 34 with which beams 32 are connected to form frame scaffold 38. One can further see two second frame parts 36 at the upper and lower connecting points to further round formwork modules 2 located vertically thereabove and therebelow. First frame parts 46 are firmly connected with edge area 18 of skin 4 and are part of side elements 16. Connected to said first frame parts 46 are arms 20 of side elements 16 protruding toward base member 14.

Thus, first frame parts 46 and second frame parts 36 form a frame for round formwork module 2 that corresponds substantially to the frame of flat, level formwork modules. To guarantee the curvability of round formwork modules 2, first frame parts 46 are merely not fastened to second frame parts 36.

It should be pointed out that secondary beams 34 and second frame parts 36 are favorably mounted so as substantially not to collide with skin 4 upon curvature of frame formwork modules 2. One can thus see in FIG. 1 that secondary beams 34 are set back from skin 4 relative to beam 32 in order to guarantee his mobility.

In FIG. 3 one can see in secondary beams 34 opening 52 through which turnbuckles 28 can be guided. One can further see in plan view steel band 40 under arms 20 of side elements 16.

Figure 4:
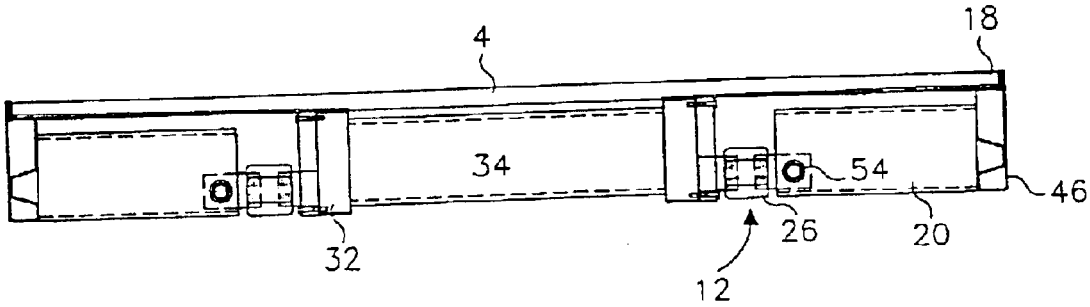
FIG. 4 shows an inventive round formwork module in the uncurved state.

FIG. 4 shows round formwork module 2 in the uncurved state. One can see that adjusting screw 12 is disposed substantially parallel to skin 4. When nut 26 of adjusting screw 12 is rotated, a force is applied to pivot 54. Due to the distance of pivot 54 from flexurally weak skin 4, or steel band 40, this force produces a moment on skin 4 that is applied to skin 4 via edge area 18 of skin 4 and moves it in either a convex or a concave direction depending on the direction of the force. Upon motion in the convex direction, i.e. use of the round formwork module as an inner formwork round formwork module, skin 4 need not be fastened to beam 32. It suffices if beams 32 form supports for skin 4.

The ratio of lengths from abutting surface of one side element 16 up to first pivot 54/first pivot 54 up to second pivot 54/second pivot 54 up to abutting surface of other side element 16 is substantially $\alpha/2\alpha/\alpha$. More precisely, the length from first pivot 54 up to second pivot 54 is somewhat greater than $2\alpha$. To determine the position of the pivot, geometrical considerations are required. The circular segment formed by skin 4 is approximated by a polygonal curve consisting of three straight lines whose lengths have the ratio $\alpha/2\alpha/60$ . The geometrical positions of the fastening points of skin 4 on beams 32 and the position of pivot 54 are then selected so that said lengths $\alpha/2\alpha/\alpha$ are obtained.

A substantially even stress distribution arises over the skin, causing it to assume substantially the form of a circular segment. Since the application of force to skin 4 is effected over edge areas 18 of skin 4, this circular segment form arises over the total length of skin 4. Thus, the lateral abutting surface of side element 16 or of first frame part 46 is automatically always substantially radial to the center of curvature.

To ensure that skin 4 remains in contact with beam 32 upon curvature in the concave direction, it is required to fix skin 4 on beams 32. It is favorable to perform this fixation so as to maintain mobility in the direction of curvature. One might use for example screws that are screwed into skin 4, or other fastening elements that are slidable in longitudinal holes extending in the direction of curvature on beams 32.

Figure 5:
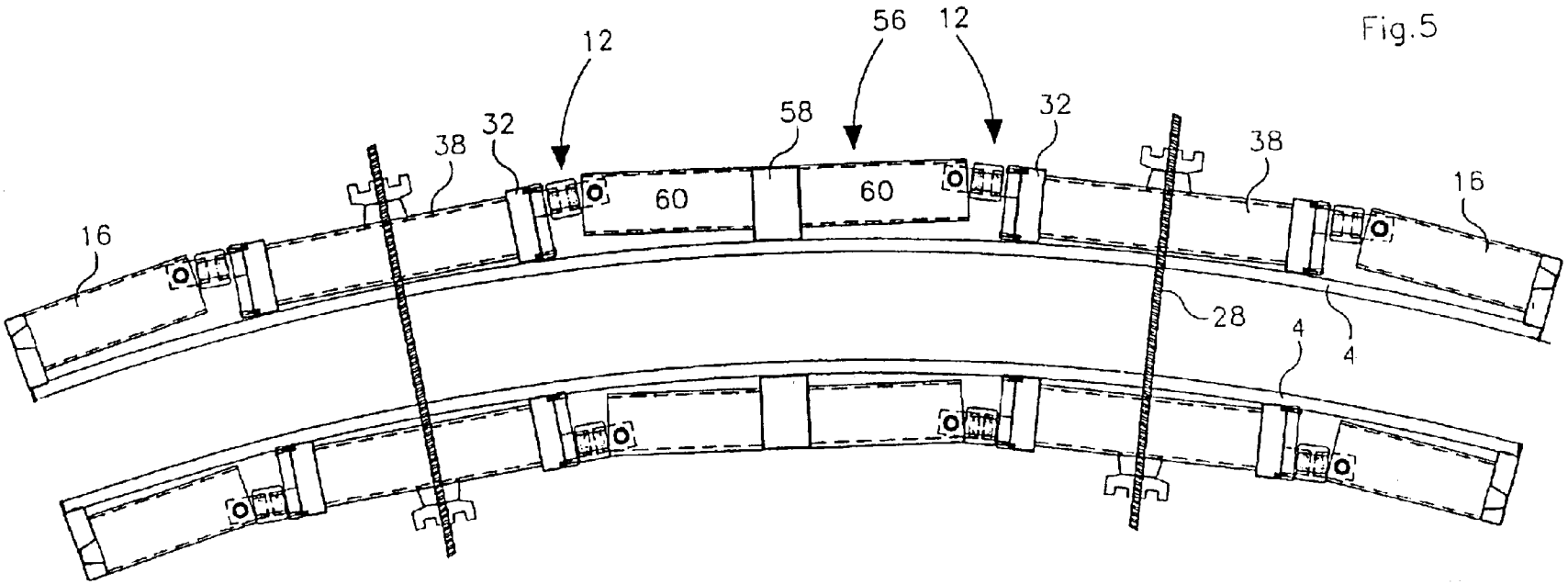
FIG. 5 shows another embodiment of an inventive round formwork module.

FIG. 5 shows an alternative embodiment of round formwork module 2 wherein two frame scaffolds 38 are interconnected via intermediate element 56. Laterally outside this combination of the two frame scaffolds 38 and intermediate element 56 there are again side elements 16 for connection to adjacent round formwork modules 2.

Intermediate element 56 has elongate central beam 58 connected to skin 4. Central beam 58 is located approximately in the middle between frame scaffolds 38 and extends in the same direction as beams 32 of frame scaffolds 38. Lateral arms 60 are fastened to central beam 58 and protrude into the proximity of frame scaffolds 38. Between arms 60 of intermediate element 56 and frame scaffolds 38, adjusting apparatuses 12 are provided for adjusting the curvature.

It is more important to adjust all adjusting devices 12 correctly to obtain the correct radius in "long" round formwork module 2 of FIG. 5 than in "short" round formwork modules 2 of FIGS. 1 to 4 Correct adjustment can be achieved, on the one hand, by placing individual round formwork modules 2 on a template having the required radius and adjusting them on said template until skin 4 matches the form of the template. Alternatively, one might also think of using the angular positions between side elements 16 and base structure 14 or between side elements 16 and frame scaffolds 38 as well as between frame scaffolds 38 and the arms of intermediate element 56 as a measure of the correct adjustment of the radius. Once said angles are determined, this permits the desired radius to be adjusted again reproducibly. One might think for example of providing scale 62 (see FIG. 1) at the ends of arms 20 or 60 in the area of the adjusting device for selecting the correct angular adjustment and thus the correct radius.

In the shown embodiment, the essential parts of the support structure are sheet-metal shaped parts of sheet steel for example, which are favorably treated with corrosion protection. However, the expert will recognize that other materials, for example extruded aluminum, can also be used.

What is claimed is:

1. A round formwork module (2) comprising a flexible skin (4) with a front (6) forming in use the shaping surface for the concrete structure to be cast, and a back (8), and a support structure (10) that is disposed on the back (8) of the skin (4) and adjustable to permit curvature of the skin (4) along a direction of extension of the skin (4), the support structure (10) having a base structure (14) and two side elements (16) disposed laterally beside the base structure (14) in the direction of curvature, the side elements (16) each being fastened to a lateral edge area (18) of the skin (4), and an adjusting apparatus (12) being provided between the base structure (14) and each of the side elements (16) for adjusting the curvature, wherein the side elements (16) extend away from the lateral edge area into the proximity of the base structure (14), and the adjusting apparatus (12) is connected to the base structure (14) or the side element (16) flexibly only on one side.

2. A round formwork module (2) according to claim 1, wherein the adjusting apparatus (12) is an adjusting screw (12).

3. A round formwork module (2) according to claim 2, wherein the adjusting screw (12) is connected rigidly to the base element (14).

4. A round formwork module (2) according to claim 1, wherein the base structure (14) has at least two beams (32) at right angles to the direction of curvature to which the skin (4) is fastened.

5. A round formwork module (2) according to claim 1, wherein the base structure (14) has two beams (32) at right angles to the direction of curvature that are connected with at least two secondary beams (34; 36) to form a frame scaffold (38).

6. A round formwork module (2) according to claim 5, wherein the base structure (14) has a plurality of frame scaffolds (38) with two interconnected beams (32) that are interconnected via an intermediate element (56).

7. A round formwork module (2) according to claim 6, wherein the intermediate element (56) has an elongate central beam (58) fastened to the skin (4) in the middle between the frame scaffolds (38) and at right angles to the direction of curvature and from which lateral arms (60) protrude into the proximity of the frame scaffolds (38), with adjusting apparatuses (12) being provided between the arms (60) of the intermediate element (56) and the frame scaffolds (38) for adjusting the curvature.

8. A round formwork module (2) according to claim 1, wherein it is designed as a frame formwork module, the side elements (18) forming first frame parts (46) for connection with round formwork modules (2) laterally adjacent in use, and second frame parts (36) are provided for connection with round formwork modules (2) vertically adjacent in use.

9. A round formwork module (2) according to claim 8, wherein the frame parts (36, 46) are folded sheet-metal shaped parts.

10. A round formwork module (2) according to claim 8, wherein the frame parts (36) have in cross section a depression (48) open toward the inside of the frame for the frame couplers (42) to engage in use for interconnecting two round formwork modules (2).

11. A round formwork module (2) according to claim 1, wherein the skin (4) is reinforced between the base structure (14) and the side elements (16).

12. A frame formwork module (2) according to claim 11, characterized in that the skin (4) is reinforced with a steel band (40).

13. A frame formwork having at least one frame formwork module (2) according to claim 1.

* * * * *